US008832873B2

(12) United States Patent
Kumar

(10) Patent No.: US 8,832,873 B2
(45) Date of Patent: Sep. 16, 2014

(54) MULTI-FUNCTIONAL, MULTI-CONFIGURABLE FURNITURE SYSTEM

(76) Inventor: Sivathanu B. Kumar, Tampa, FL (US)

( * ) Notice: Subject to any disclaimer, the term of this patent is extended or adjusted under 35 U.S.C. 154(b) by 211 days.

(21) Appl. No.: 13/534,443

(22) Filed: Jun. 27, 2012

(65) Prior Publication Data

US 2013/0257234 A1 Oct. 3, 2013

Related U.S. Application Data

(63) Continuation-in-part of application No. 12/802,086, filed on May 28, 2010, now Pat. No. 8,407,830.

(60) Provisional application No. 61/217,613, filed on Jun. 2, 2009, provisional application No. 61/404,151, filed on Sep. 28, 2010, provisional application No. 61/402,963, filed on Sep. 8, 2010.

(51) Int. Cl.
*A47B 85/00* (2006.01)

(52) U.S. Cl.
USPC ..... 5/3; 5/2.1; 5/5; 312/240

(58) Field of Classification Search
USPC ..... 312/240, 237, 257.1, 235.2, 235.3, 312/235.4, 235.5, 313, 314, 315, 316, 312/317.1, 317.3; 5/2.1, 3, 5, 6, 7, 133, 5/136, 159.1, 160
See application file for complete search history.

(56) References Cited

U.S. PATENT DOCUMENTS

| | | | | |
|---|---|---|---|---|
| 117,632 | A * | 8/1871 | Hopfs | 5/2.1 |
| 266,860 | A * | 10/1882 | Meissner | 5/164.1 |
| 3,088,127 | A * | 5/1963 | Eames | 5/2.1 |
| 3,858,253 | A * | 1/1975 | Lauzon | 5/2.1 |
| 4,866,798 | A * | 9/1989 | Harris | 5/263 |
| 5,152,593 | A * | 10/1992 | Domenig | 312/245 |
| 6,401,276 | B1 * | 6/2002 | Sherman | 5/136 |
| 2002/0133882 | A1 * | 9/2002 | Chapman et al. | 5/713 |
| 2006/0107456 | A1 * | 5/2006 | Joseph | 5/2.1 |

* cited by examiner

*Primary Examiner* — James O Hansen

(57) ABSTRACT

The components of the furniture system, in a vertical orientation, have a cabinet with a central opening in an upper section and a plurality of support panels stacked in a laterally oriented position within the central opening. The cabinet is adapted to be placed against a structure such as a wall. Engaging items include a television. The cabinet further has a horizontal orientation with a top opening and alternate configuration and function such as a bed or sofa. In this configuration the support panels are repositionable to span the entire horizontal top opening of the cabinet. The repositioning of such components is done by mechanisms such as hinges, rails and/or manually repositioning the components.

4 Claims, 28 Drawing Sheets

MULTI-FUNCTIONAL, MULTI-CONFIGURABLE FURNITURE SYSTEM

RELATED APPLICATION

The present non-provisional patent application is a continuation-in-part of pending U.S. patent application Ser. No. 12/802,086 filed May 28, 2010 which in turn is based upon Provisional Patent Application Ser. No. 61/217,613 filed Jun. 2, 2009, the subject matter of which applications is incorporated herein by reference.

BACKGROUND OF THE INVENTION

1. Field of the Invention

The present invention relates to a multi-functional, multi-configurable furniture system and more particularly pertains to converting a piece of furniture from a cabinet during the day to a bed during the night in a safe, convenient, eye-appealing and economical manner.

2. Description of the Prior Art

The use of furniture systems of known designs and configurations is known in the prior art. More specifically, furniture systems of known designs and configurations previously devised and utilized for the purpose of converting a cabinet used during the day to a bed for use at night are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a multi-functional, multi-configurable furniture system that allows for converting a piece of furniture from a cabinet during the day to a bed during the night in a safe, convenient, eye-appealing and economical manner.

In this respect, the multi-functional, multi-configurable furniture system according to the primary and alternate embodiments of the present invention substantially departs from the conventional concepts and designs of the prior art, and in doing so provides an apparatus primarily developed for the purpose of for converting a piece of furniture from a cabinet during the day to a bed during the night in a safe, convenient, eye-appealing and economical manner.

Therefore, it can be appreciated that there exists a continuing need for a new and improved multi-functional, multi-configurable furniture system which can be used for converting a piece of furniture from a cabinet during the day to a bed during the night in a safe, convenient, eye-appealing and economical manner.

In this regard, the present invention substantially fulfills this need.

SUMMARY OF THE INVENTION

In view of the disadvantages inherent in the known types of furniture systems of known designs and configurations now present in the prior art, the present invention provides an improved multi-functional, multi-configurable furniture system. As such, the general purpose of the present invention, which will be described subsequently in greater detail, is to provide a new and improved multi-functional, multi-configurable furniture system and method which has all the advantages of the prior art and none of the disadvantages.

To attain this, the present invention essentially comprises a multi-functional, multi-configurable furniture system. The components of the furniture system, in a vertical orientation, have a cabinet. The cabinet further has a central opening in an upper section and a plurality of support panels which are stacked in a laterally oriented position within the central opening. The cabinet is adapted to be placed against a structure such as a wall. Engaging items include a television. The cabinet further has a horizontal orientation with a top opening and alternate configuration and function such as a bed or sofa. In this configuration the support panels are repositionable to span the entire horizontal top opening of the cabinet. The repositioning of such components is done by mechanisms such as hinges, rails and or manually repositioning the components.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-functional, multi-configurable furniture system which has all of the advantages of the prior art furniture systems of known designs and configurations and none of the disadvantages.

It is another object of the present invention to provide a new and improved multi-functional, multi-configurable furniture system which may be easily and efficiently manufactured and marketed.

It is further object of the present invention to provide a new and improved multi-functional, multi-configurable furniture system which is of durable and reliable constructions.

An even further object of the present invention is to provide a new and improved multi-functional, multi-configurable furniture system which is susceptible of a low cost of manufacture with regard to both materials and labor, and which accordingly is then susceptible of low prices of sale to the consuming public, thereby making such multi-functional, multi-configurable furniture system economically available to the buying public.

Even still another object of the present invention is to provide a multi-functional, multi-configurable furniture system for converting a piece of furniture from a cabinet to a bed in a safe, convenient, eye-appealing and economical manner.

Lastly, it is an object of the present invention to provide a new and improved multi-functional, multi-configurable furniture system adapted to provide a plurality of configurations, functions and components, wherein the components are of the furniture system.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 showing the cabinet engaging a television

The same reference numerals refer to the same parts throughout the various Figures.

DESCRIPTION OF THE PREFERRED EMBODIMENT

Figure 19:
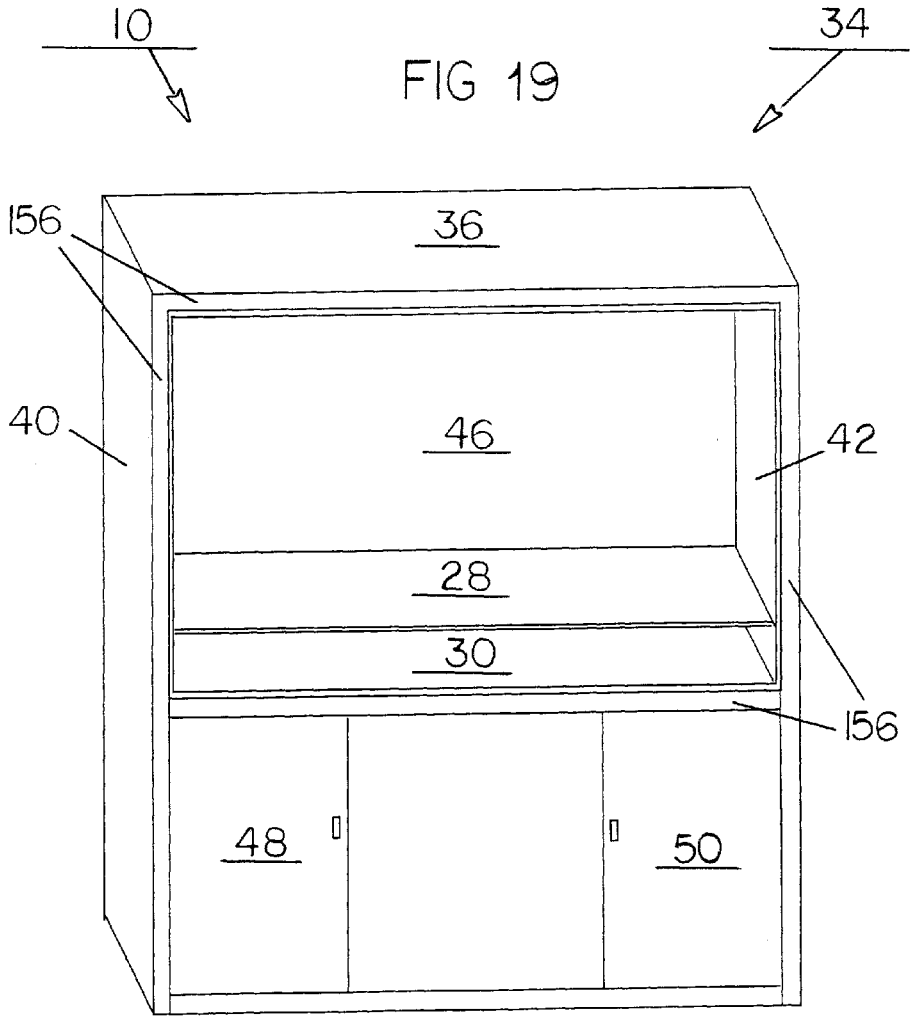
FIG. 19 and FIG. 20 are the front perspective illustration of a multi-functional, reconfigurable furniture system constructed in accordance with the principles of the present invention.
Figure 20:
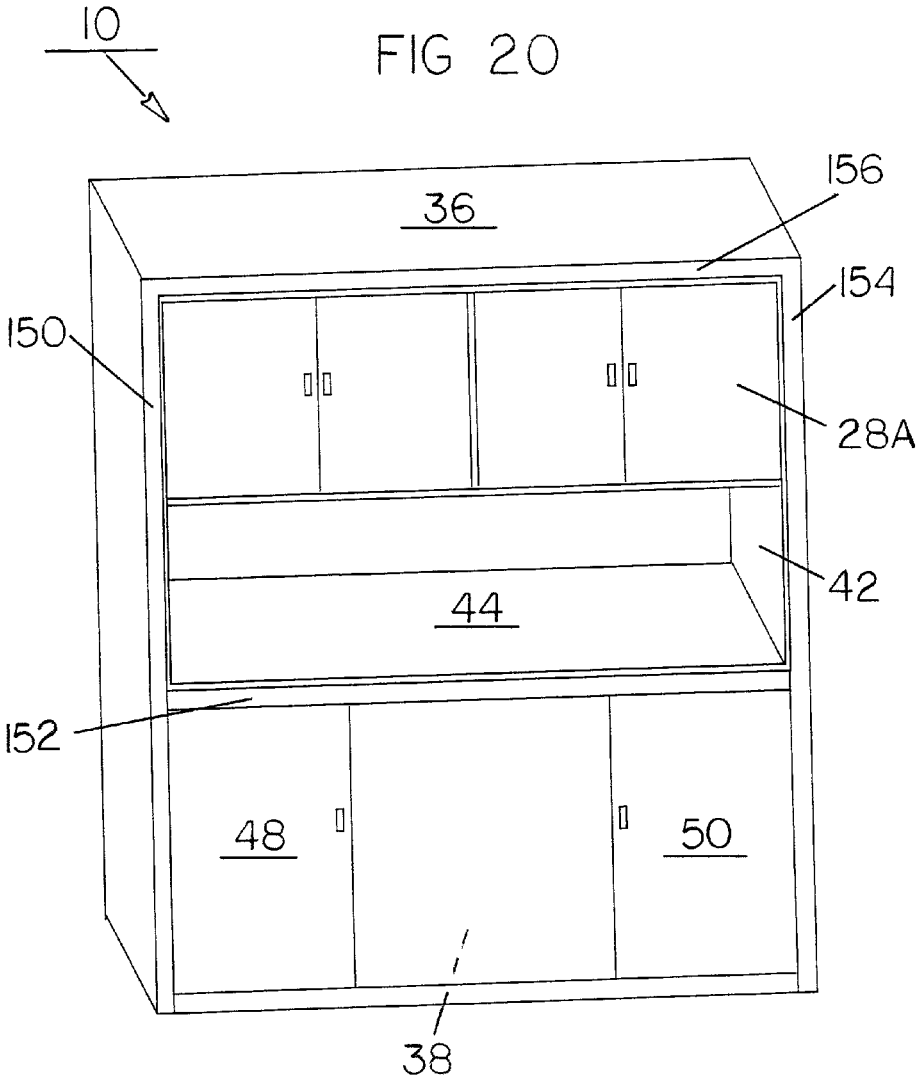
Figure 21:
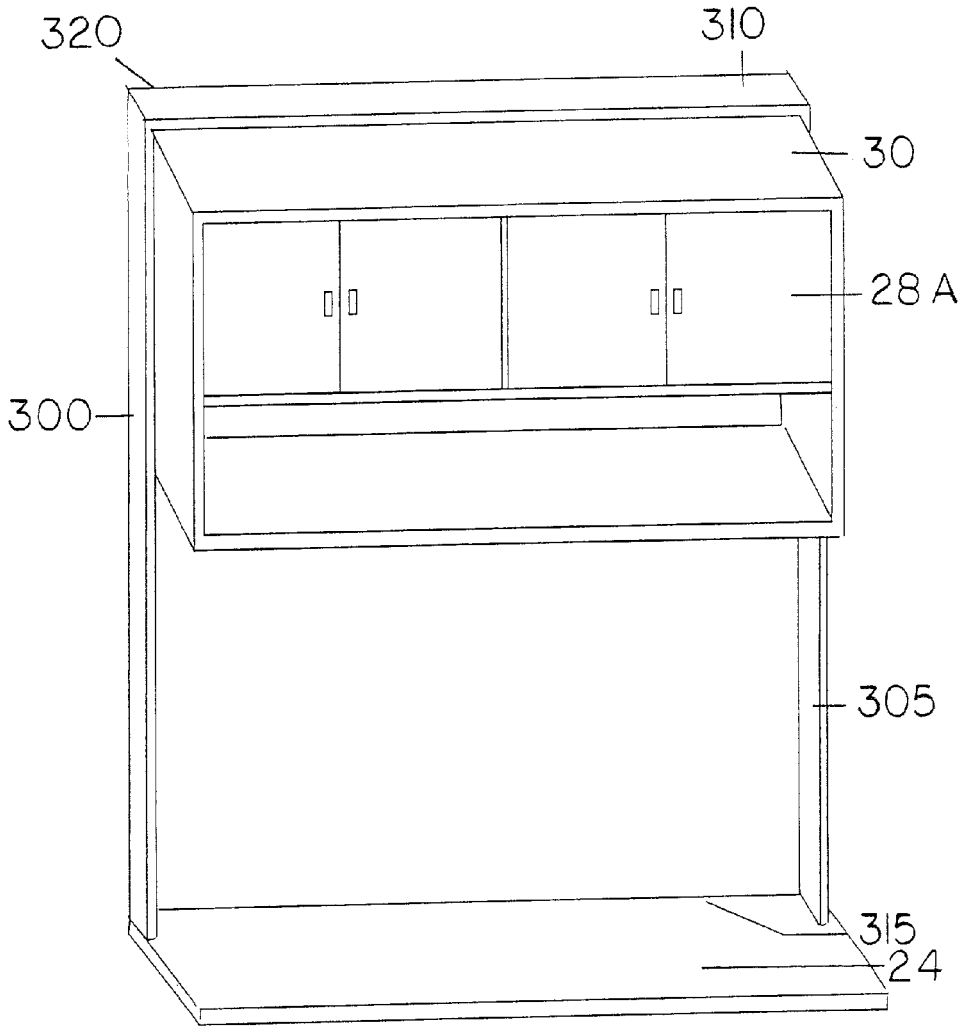
FIG. 21 and FIG. 22 are a front perspective illustration of the multi-functional, multi-configurable furniture system having the accessory components and secondary storage space.
Figure 22:
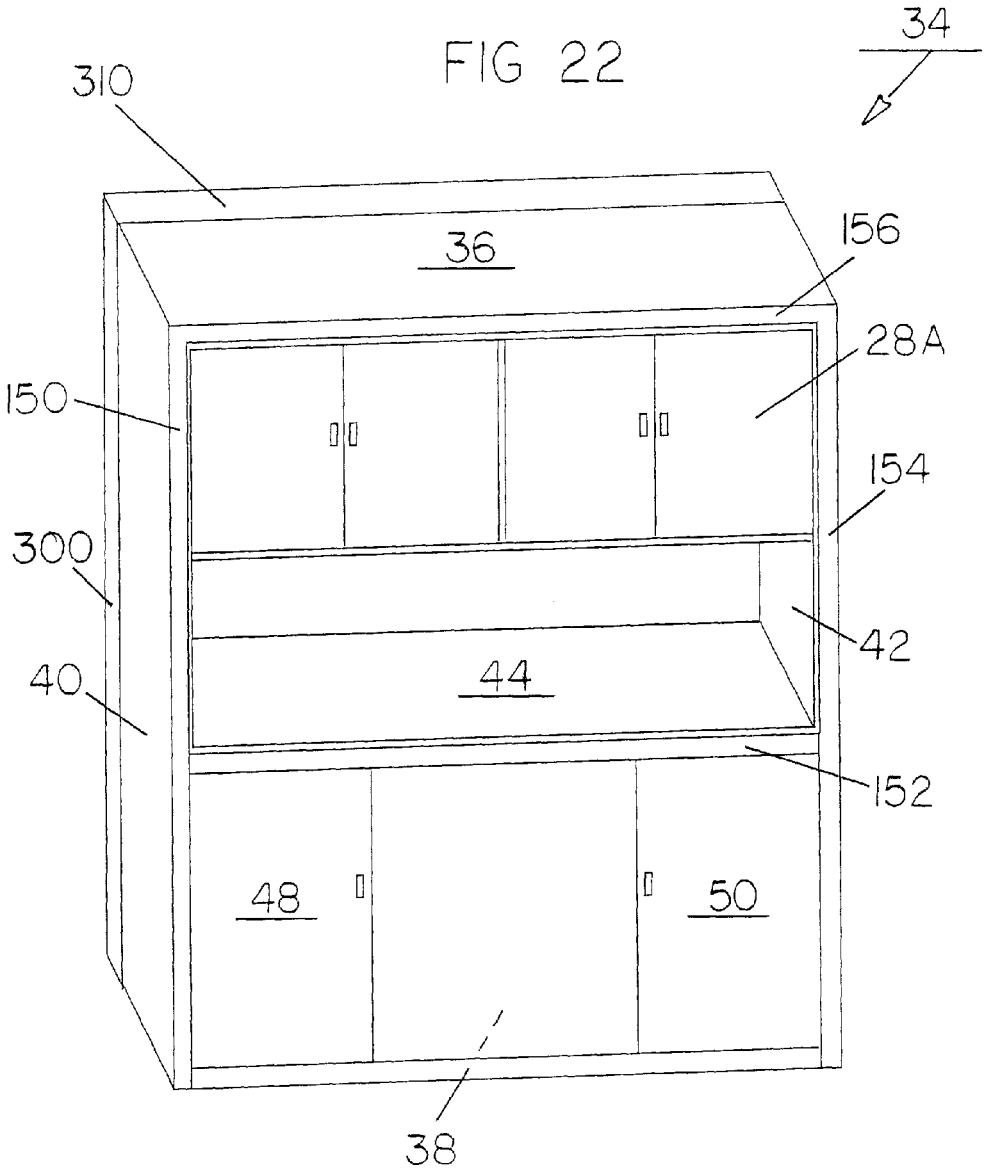
Figure 23:
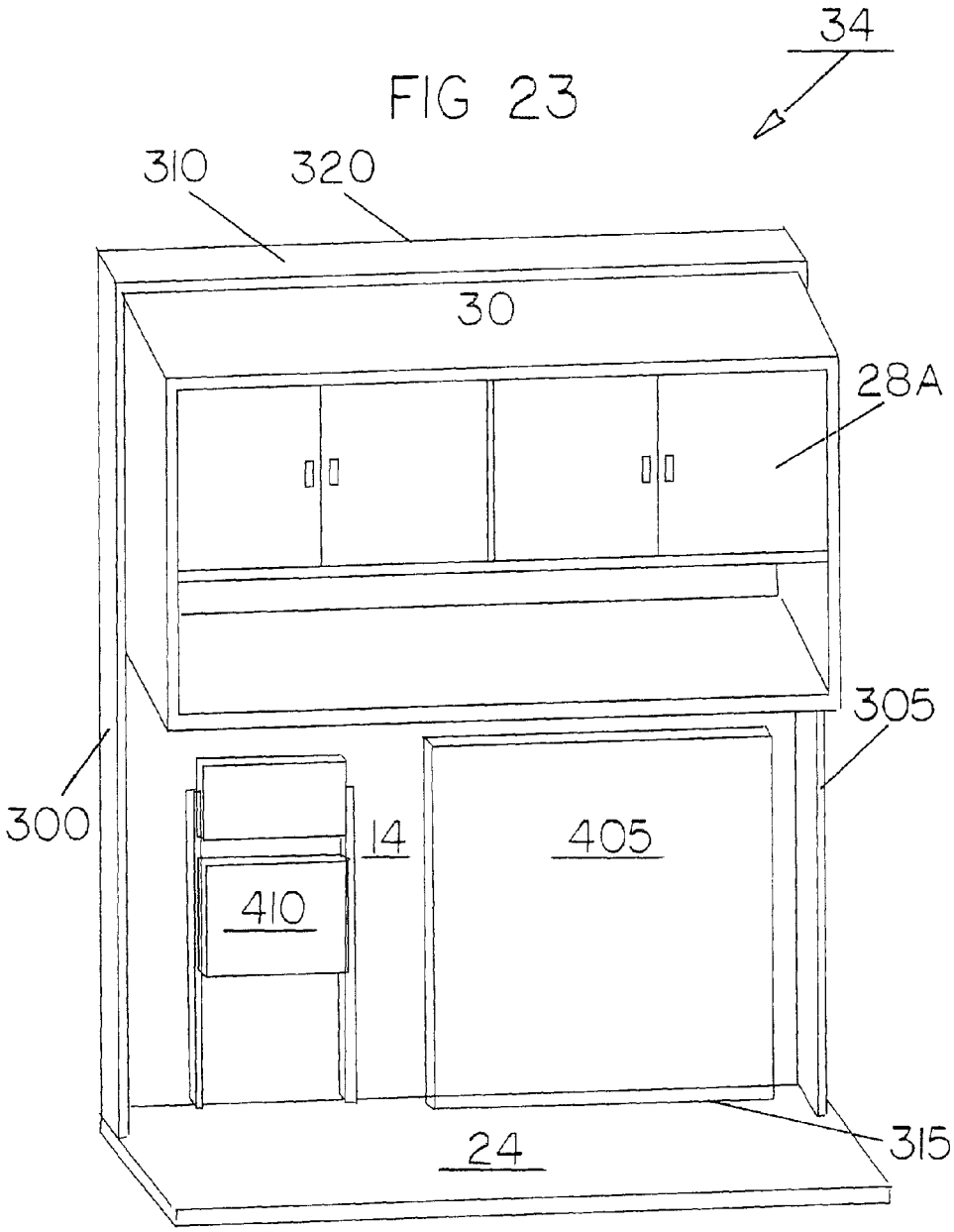
FIG. 23 and FIG. 24 are front perspective illustration of the multi-functional, multi-configurable furniture system having the accessory components and secondary storage space, and the secondary storage having space for storing chairs and table and operationally coupled with the table.
Figure 24:
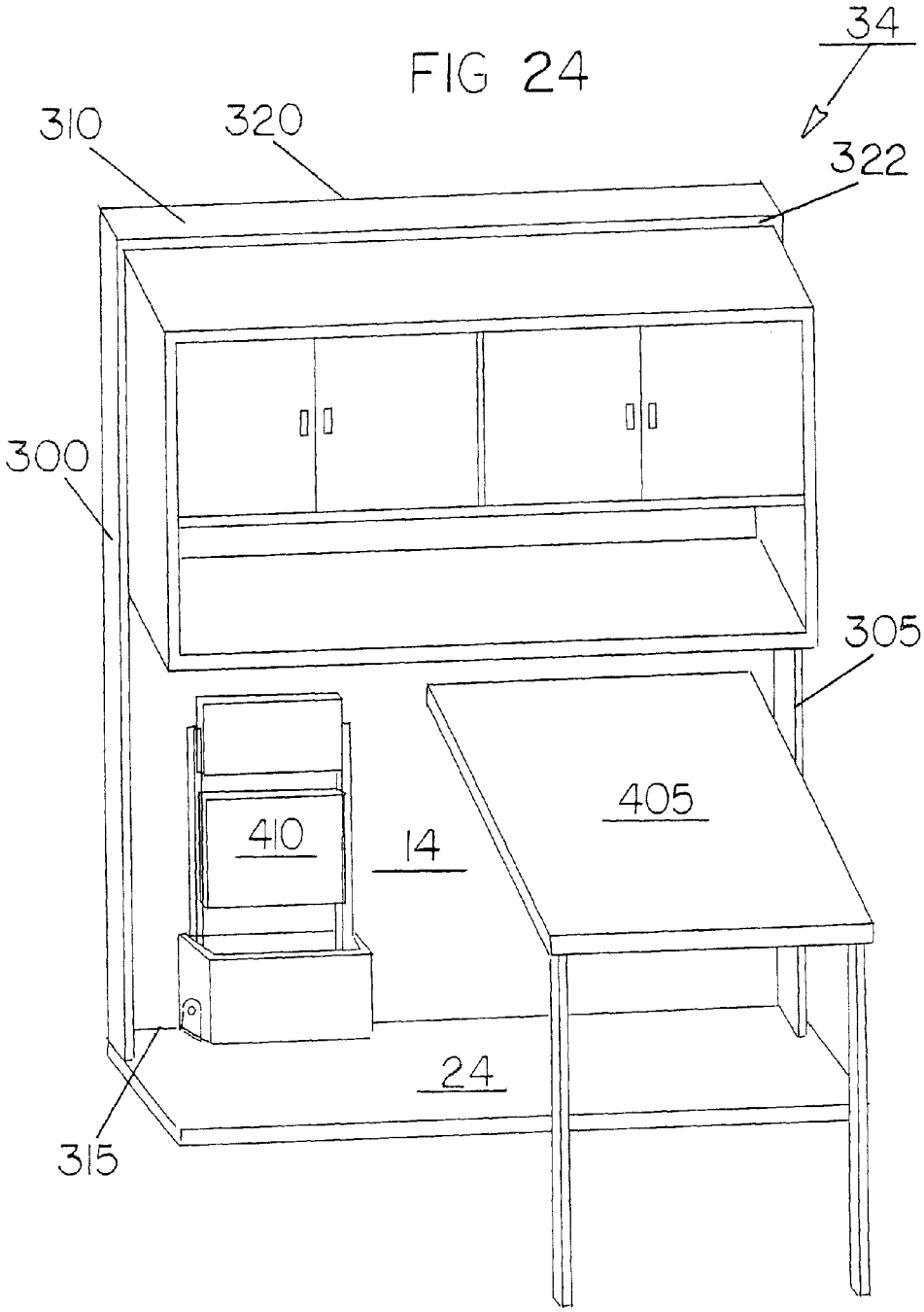
Figure 25:
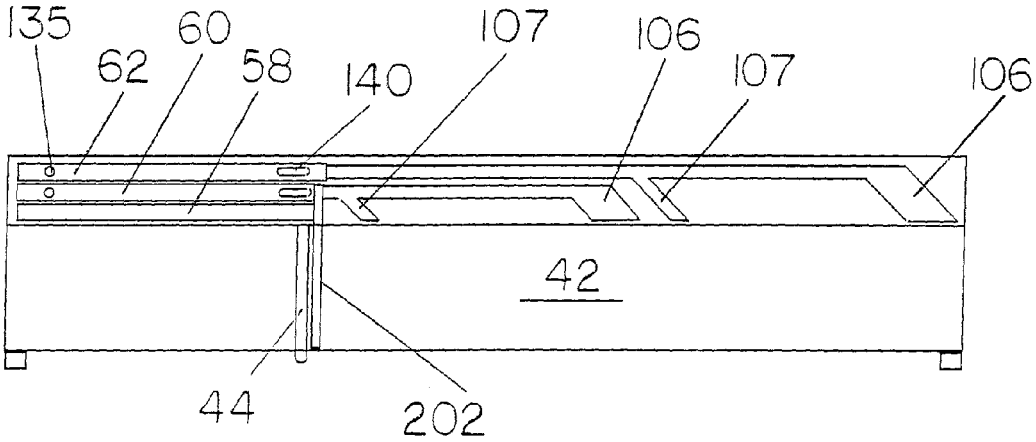
FIG. 25 and FIG. 26 is side elevational view of the rails.
Figure 26:
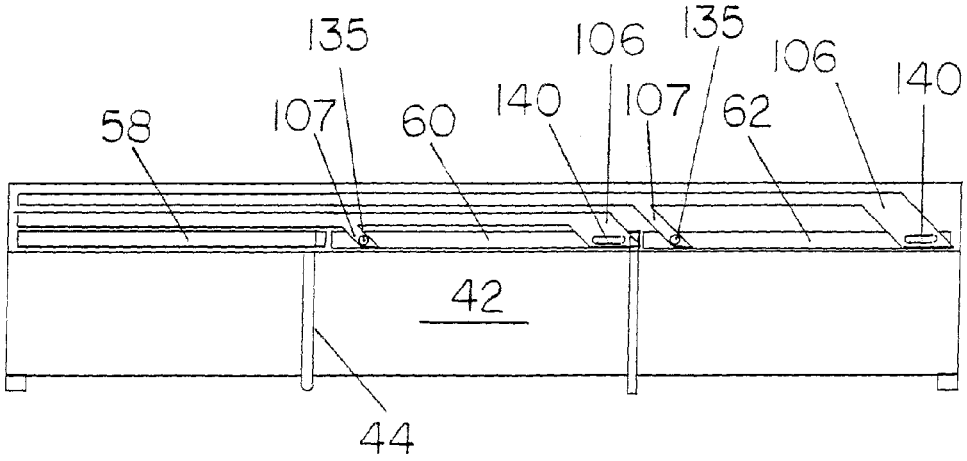
Figure 27:
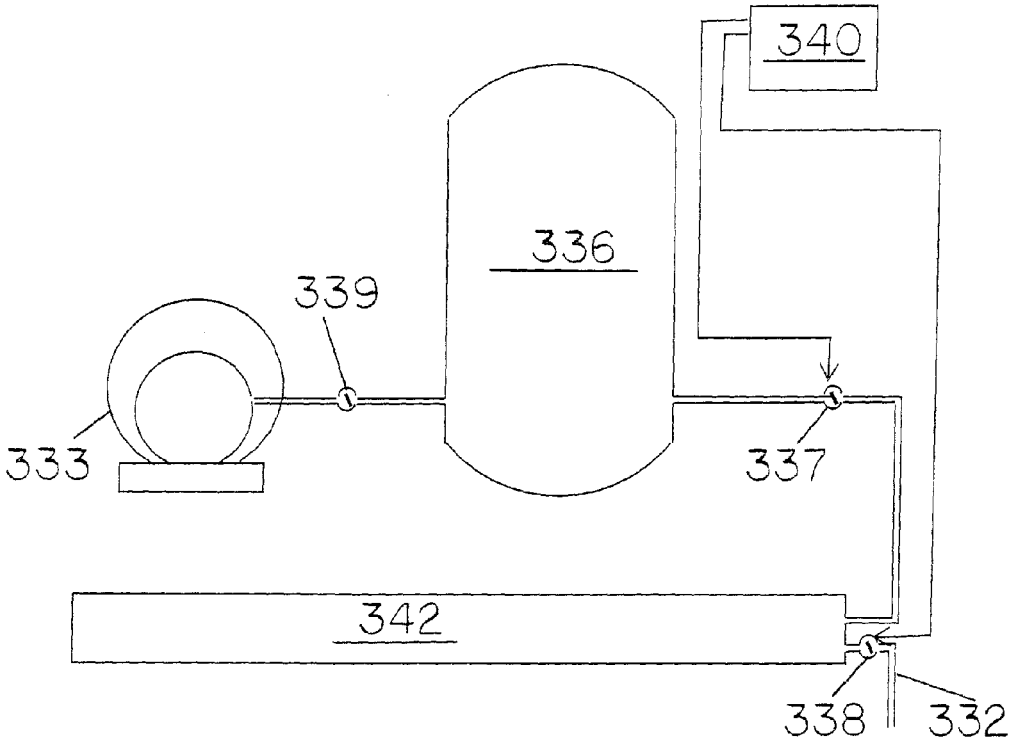
FIG. 27 is the side elevational view of illustrating an alternate embodiment of the invention wherein an alternate embodiment has an optional air compressor 333 and tank 336 for storing compressed air. A valve 339 operatively coupled to the pipe supplying the compressed air to the tank, a second valve 338 coupled to the pipe that is coupled to the mattress and a third valve that is supplying the compressed air from the tank to the inflatable mattress are provided.

With reference now to the drawings, and in particular to FIG. 19 and FIG. 20 thereof, the preferred embodiment of the new and improved multi-functional, reconfigurable furniture system embodying the principles and concepts of the present invention and generally designated by the reference numeral 10 will be described.

The present invention, the multi-functional, multi-configurable furniture system is comprised of a plurality of components. Such components in their broadest context include a cabinet, a plurality of support panels and repositioning means for the support panels such as hinges and rails, further consisting of major shelving and box shaped shelving assemblies and back plate and accessory components. The box shaped shelving assemblies further containing minor shelving and minor cabinets, and is adapted to be secured to other structures such as a wall.

The box shaped shelving assemblies are further adapted to be secured to the back plate; such components are individually configured and correlated with respect to each other so as to attain the desired objective.

The central opening 46 is provided in the cabinet and this central opening is adapted to receive and engage the major hselving and box shaped shelving assemblies.

The multi-functional, multi-configurable furniture system 10 of the present invention is for conversion to but not limited to a cabinet and a bed or sofa as need be. Such conversions are done in a safe, convenient, eye-appealing and economical manner.

First provided is a cabinet 34. The cabinet has a horizontal upper plate 36 and a parallel lower plate 38. The upper and lower plates of the cabinet are separated by a height of 6 feet. The cabinet has a vertical left side plate 40 and a parallel right side plate 42. The left and right side plates of the cabinet are separated by a width of 7 feet. The cabinet has a horizontal intermediate plate 44. A central opening 46 is provided between the horizontal intermediate plate 44, the horizontal upper plate 36, the vertical left side plate 40 and the vertical right side plate 42. A left housing 48 with front doors is in the left side opening and is secured to the left of the lower plate. The left housing has a height of 1.5 feet. A right housing 50 with front doors is in the right side opening and is secured to the right side of the lower plate. The right housing has a height of 1.5 feet. The cabinet is movable between a horizontal orientation and a vertical orientation. In a horizontal orientation the cabinet is positioned upon the floor laterally spaced from a wall or the foot plate with the upper and lower plates vertically disposed. In a vertical orientation the cabinet is positioned abutting against the wall or upon the foot plate and against the back plate and the upper and lower plates horizontally disposed.

Next provided is the inner surface of the left side plate 40, right side plate 42, the upper plate 36, and the bottom plate 38 of the cabinet is provide with load bearing peripheral plates 72 that extends, upwardly from the bottom edges of the top edges of the left side plate 40, right side plate 42, the upper plate 36, and the bottom plate 38 of the cabinet to the bottom of the bottom rails 110. The left and right bottom edges of the support panel engages the top edges of the load bearing peripheral plates 72 and thus the load bearing peripheral 72 providing the peripheral support for the support panels for bearing the load of the mattress.

Next provided are cover plates 150, 152, 154, 156. The back surface of the cover plates 150, 152, 154, are attached to the front edges of the left side plate 40, right side plate 42, the upper plate 36, and the intermediate plate 44 of the cabinet and extends inwardly from the front edges of the left side plate 40, right side plate 42, upper plate 36, and the intermediate plate 44 towards the center opening of the cabinet. The cover plates 150, 152, 154, 156 has a width equal to at least the width of the front edges of the left side plate 40, right side plate 42, the upper plate 36, and the intermediate plate 44 of the cabinet and part or whole of the width of the front edges of the box shaped shelving assemblies or horizontal major shelf. The inwardly extending section of the cover plates 150, 152, 154, 156 cover a part or whole of the linear peripheral edges of the left, a right, the top and bottom front edges of the box shaped shelving assemblies and horizontal major shelf. The cover plates 150, 152, 154, 156 makes the peripheral edges of the left, a right, the top and bottom front edges of the box shaped shelving assemblies and horizontal major shelf and the edged of the left side plate 40, right side plate 42, the upper plate 36, and the intermediate plate 44 of the cabinet appear as one edge. Thus the cover plate improves appearance is improvement makes this furniture configuration viable.

Next provided is a mattress such as but not limited to an inflatable mattress 56 is provided. The inflatable mattress is adapted to be deflated and inserted into one of the housings when the cabinet is in the vertical orientation. The mattress is adapted to be inflated and placed upon the cabinet when in the horizontal orientation. Inflation is preferably through air, but other fluids could be used such as gas or liquid.

Next provided is at least three similarly configured support panels 58, 60, 62 are provided. The support panels are coupled to the cabinet. The panels include a lower panel 58 secured to the cabinet and having a rear opening with a door and with hinges coupled to the middle 60 and upper 62 support panels for pivoting to stalk and position the support panels 58, 60, 62 in the lower section of the cabinet when in the vertical orientation and to a position spanning the openings when in the horizontal orientation. The panels also include two upper panels, the middle 60 and upper 62 with hinges 66, 68, and rails 105, 110 for stacking the, the middle 60 and upper 62 panels upon the lower plate when the cabinet is in the vertical orientation. The support panels are re-positionable for spanning the openings when in the horizontal orientation. In this manner, the panels will cover the openings and provide full support for the inflated mattress.

It is within the scope of this invention that the plurality of support panels stalked in the spaces of the cabinet be repositioned using plurality of mechanisms such as but not limited to repositioning manually, using hinges or rails.

Next provided is additional support and reinforcement for bearing increased weight of a larger, wider or heavier mattress that is exerted in the middle region of the central opening of the cabinets, generally for supporting heavier loads the support panels are being operatively coupled with rails and the intermediate support panel is further provided with repositionable center mattress support members.

In a horizontal orientation, the top section of the inner surface of the left 40 and right 42 plates of the cabinets each have at least two sets of rails 105, 110 secured to the top inner surface of the left and right plates 40, 42 of the cabinet and above the top edges of the load bearing peripheral plates and extending from back to front, one rail on top 105 and the second being below the top rail and being parallel to each other.

The bottom rails 110 extends from the bottom plate of the cabinet 34 to the middle one third sections of the upper 36 and lower 38 plates of the cabinet and has two downwardly turned extensions which are turned downwards 90 or less than 90 degrees, the front downwardly turned extensions 106 being wider in cross section than the back downwardly turned extensions 107.

The top rails 105 extends from the bottom plate of the cabinet 34 to the one third sections of the center opening of the cabinet that are closest to the upper plate of the cabinet and has two downwardly turned extensions which are turned downwards 90 or less than 90 degrees, the front downwardly turned extensions 106 is wider in cross section than the back downwardly turned extensions 107.

The front downwardly turned extensions 106 is adapted couple with guiding post 140 of the support panel and the back downwardly turned extensions 106 is adapted couple with guiding pin 135 of the support panel.

The distance between the front downwardly turned extensions 106 and the back downwardly turned extensions 107 is similar in dimension as the distance between the guide pin 135 and post 140 of the support panel.

The rails provided are either secured to the inner surface of the left and right plates of the cabinet externally or being set within internally within channels in the left and right plates of the cabinet.

The lower rail provides the repositioning of the middle support panel 60 from a position that is stalked over the lower support panel 58 to a forward position that is the mid section between the upper and lower plates of the cabinet and in the center opening of the cabinet.

The upper rail provides the repositioning of the upper support panel 62 from a position that is stalked over the lower support panel 58 and the middle support panel 60 to a forward position that is the ⅓ section and closer to the upper plates of the cabinet and in the center opening of the cabinet.

Provided in the left 120 and right 125 edges of the support panel and in closer proximity to the back edges 121 of the support panels 60 are guide pins 130, 135 which are generally circular in cross section. Provided in the left 120 and right 125 edges and in closer proximity to the front edges 126 of the support panels are guide posts 140, 145 which are generally rectangular with rounded edges in cross section.

Next provided is the center mattress support members is further provided with one or more center mattress support members 201, 202 the center mattress support members 201, 202 are rectilinear and extends in a downwardly direction and the dimension of height being generally equal or greater in length of the dimension from the top edges of the load bearing peripheral plates 72 and the bottom edges of the upper plate 36, bottom plate 38, left side plate 40 and right side plate 42, the center mattress support members being fixedly abutting at the bottom surface and in a close proximity to the front edges 126 of the middle support panel 60.

Next the support panels are provided with linear recess channel 205 generally 0.25 inches to 0.50 inches in depth and formed in the lower surface and in close proximity along the left 120 and right 125 edges of the support panels 58, 60, 62 and this linear recess channel 205 is adapted to receive the inner half section of the top edges 210 of the load bearing peripheral plates, the inner 50 percent of the peripheral edges of the top, bottom, left and right load bearing peripheral plates being 0.25 inches to 0.50 inched higher. This is adapted to reinforce structural stability and to prevent unwanted buckling and lateral displacement of the upper plate 36, bottom plate 38, left side plate 40, and right side plate 42 of the cabinet.

Figure 1:
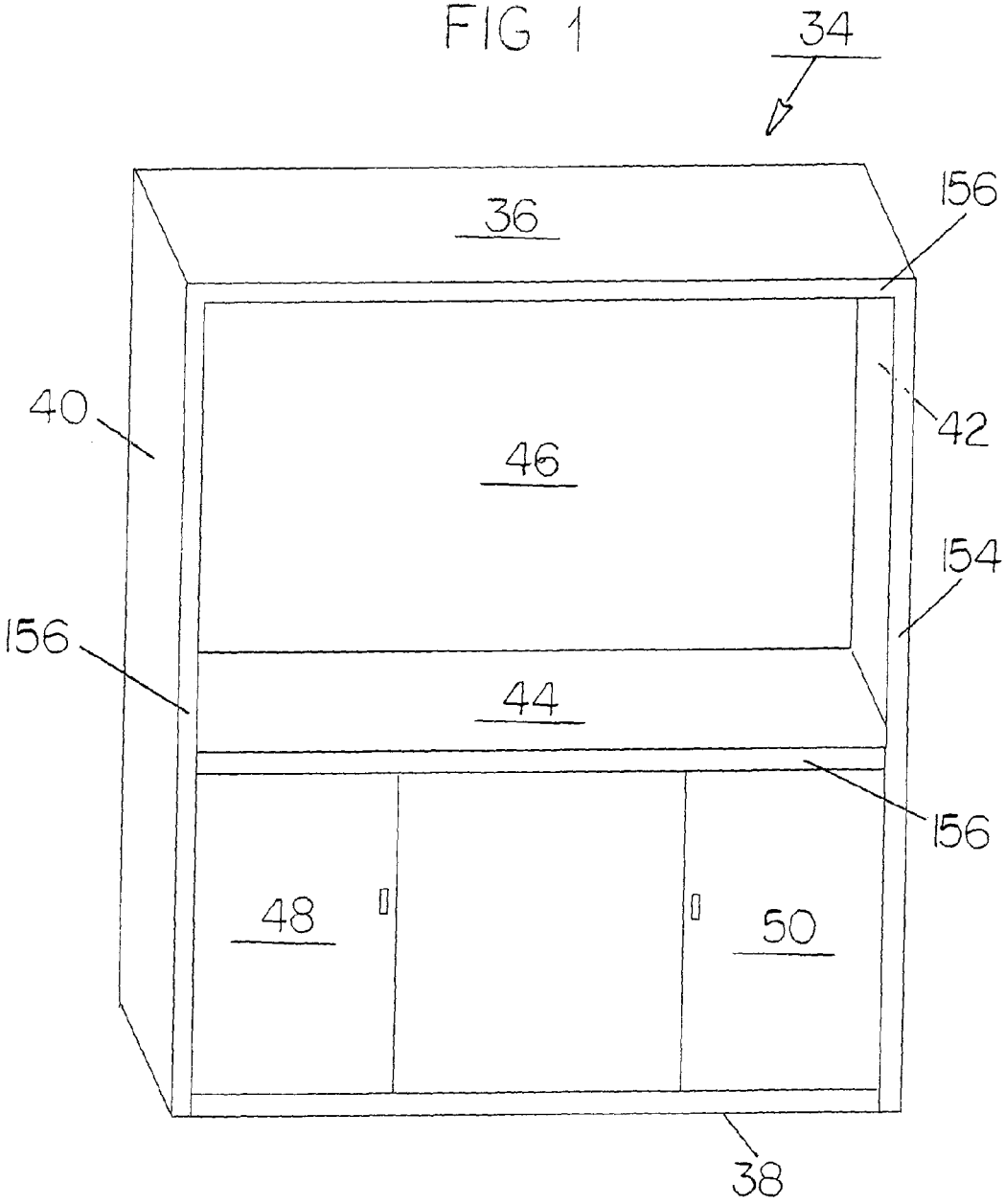
FIG. 1 and FIG. 2 are a front perspective illustration of the cabinet of the multi-functional, multi-configurable furniture system.
Figure 2:
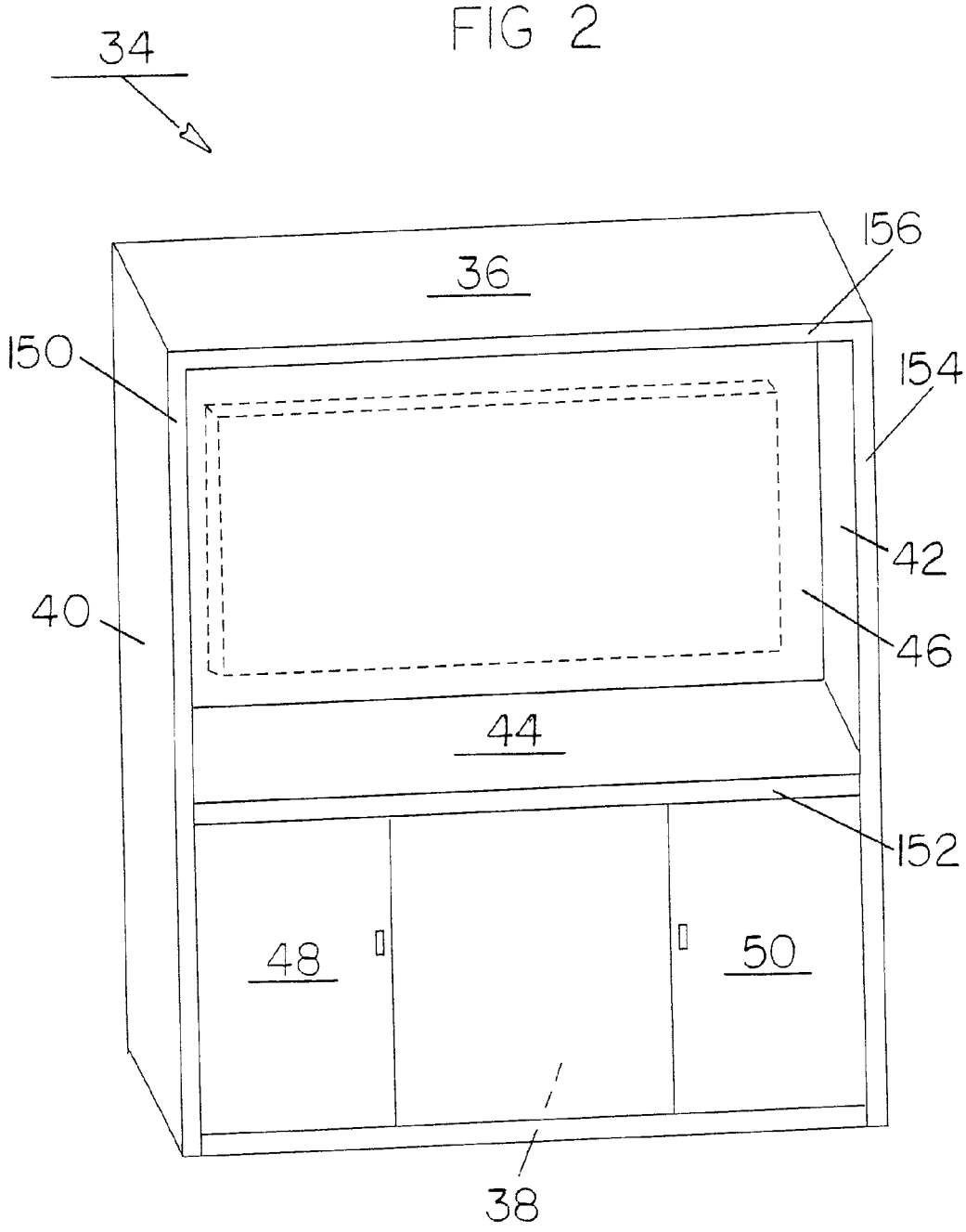
Figure 3:
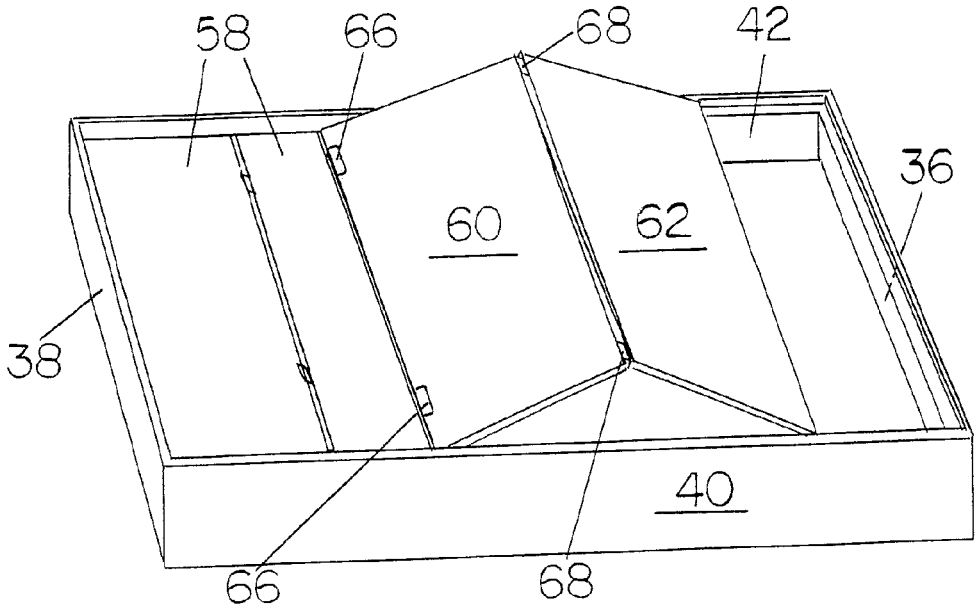
FIG. 3 is a plan view of the rear of the cabinet shown in FIGS. 1 and 2 but with the support panels having hinges being closed.
Figure 4:
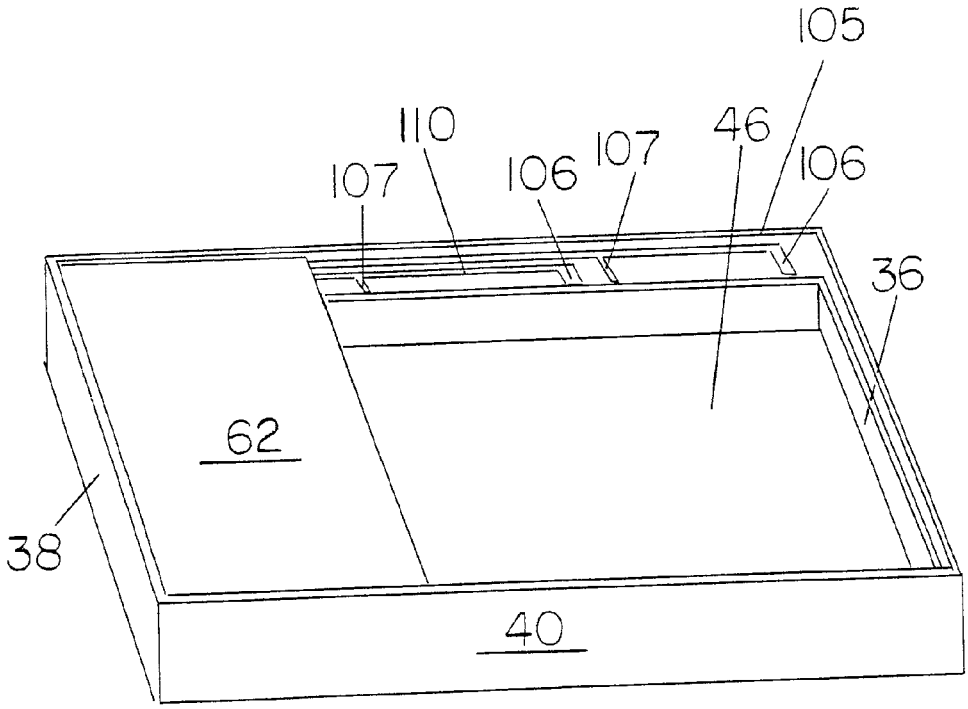
FIG. 4, FIG. 5 and FIG. 6 are plan views of the rear of the cabinet shown in FIGS. 1 and 2 but with the support panels having rails being closed.
Figure 5:
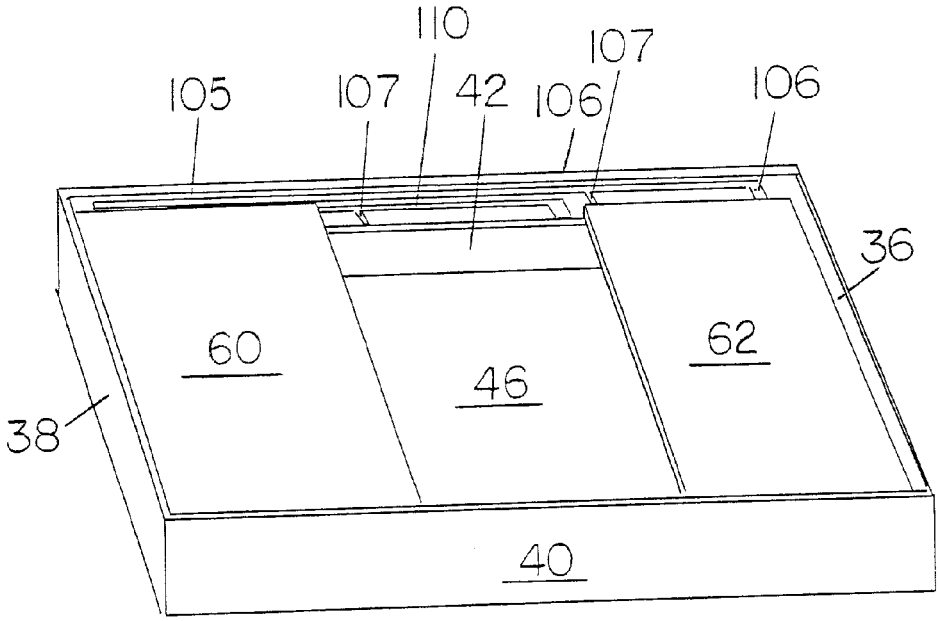
Figure 6:
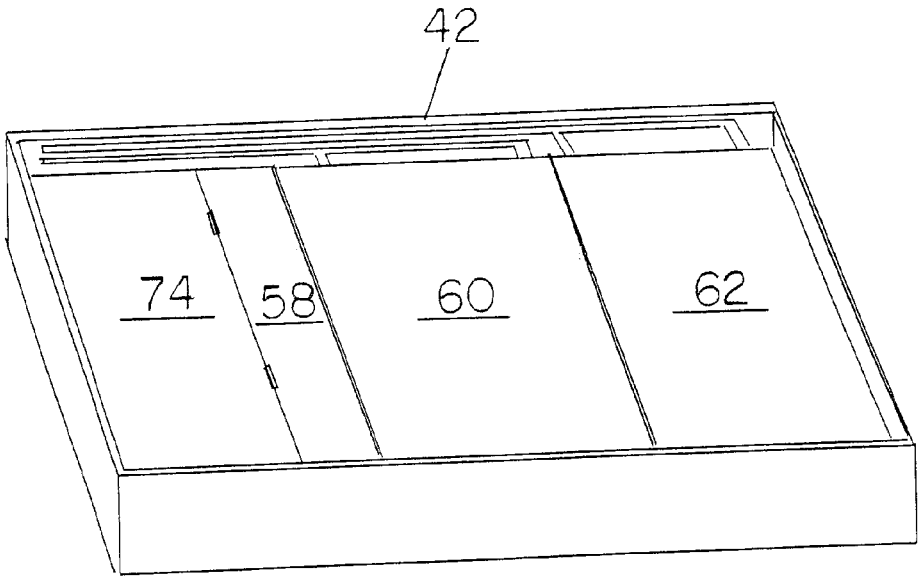
Figure 7:
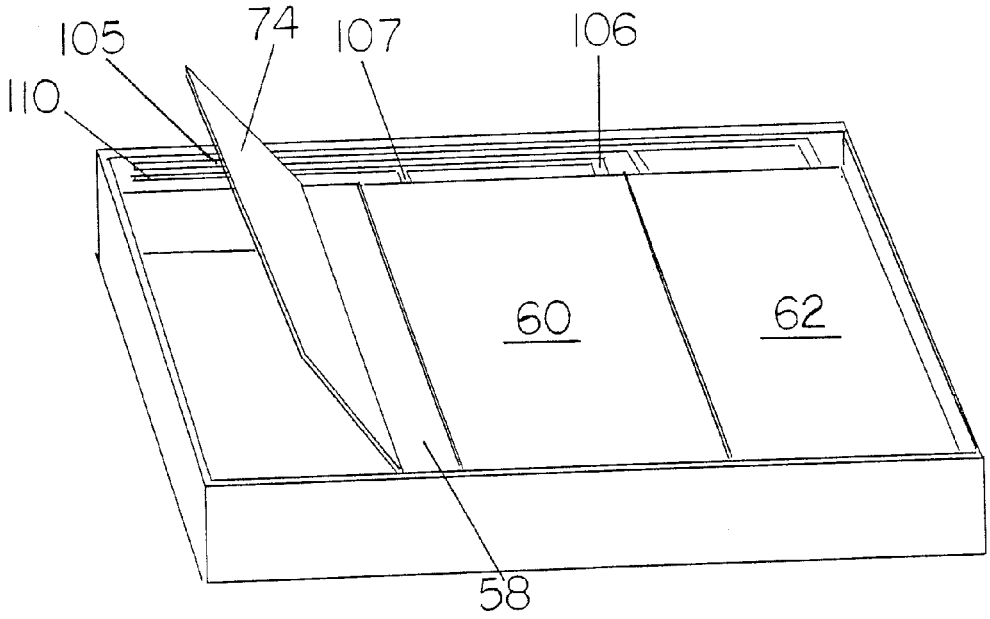
FIG. 7 is a plan view of the rear of the cabinet shown in FIG. 4, FIG. 5 and FIG. 6 but with the lower support panels having open rear door.
Figure 8:
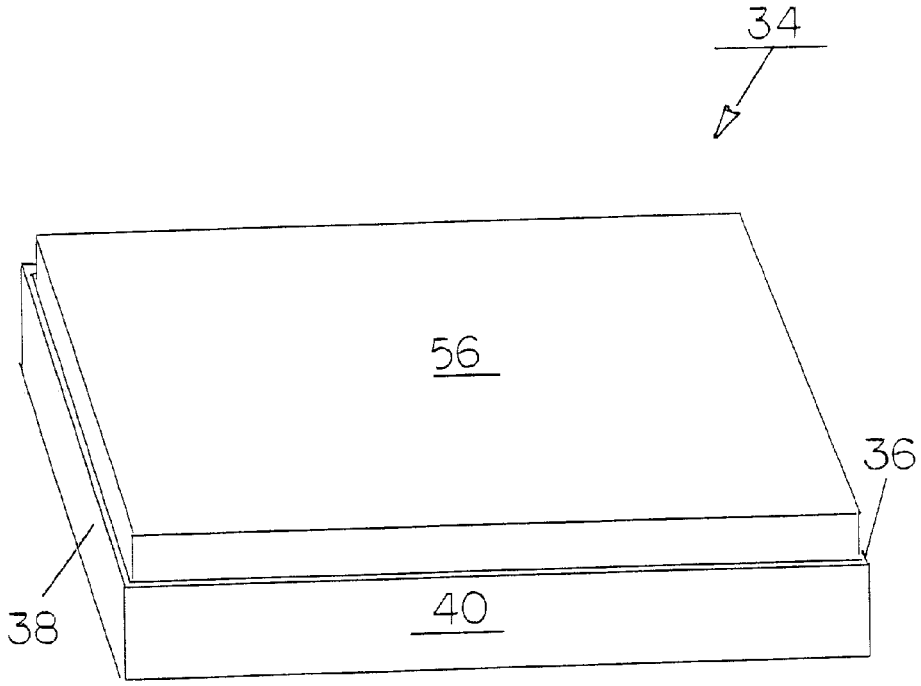
FIG. 8 is a plan view similar to FIGS. 3, 4, 5, and 6 but with a mattress positioned upon the closed support panels.
Figure 9:
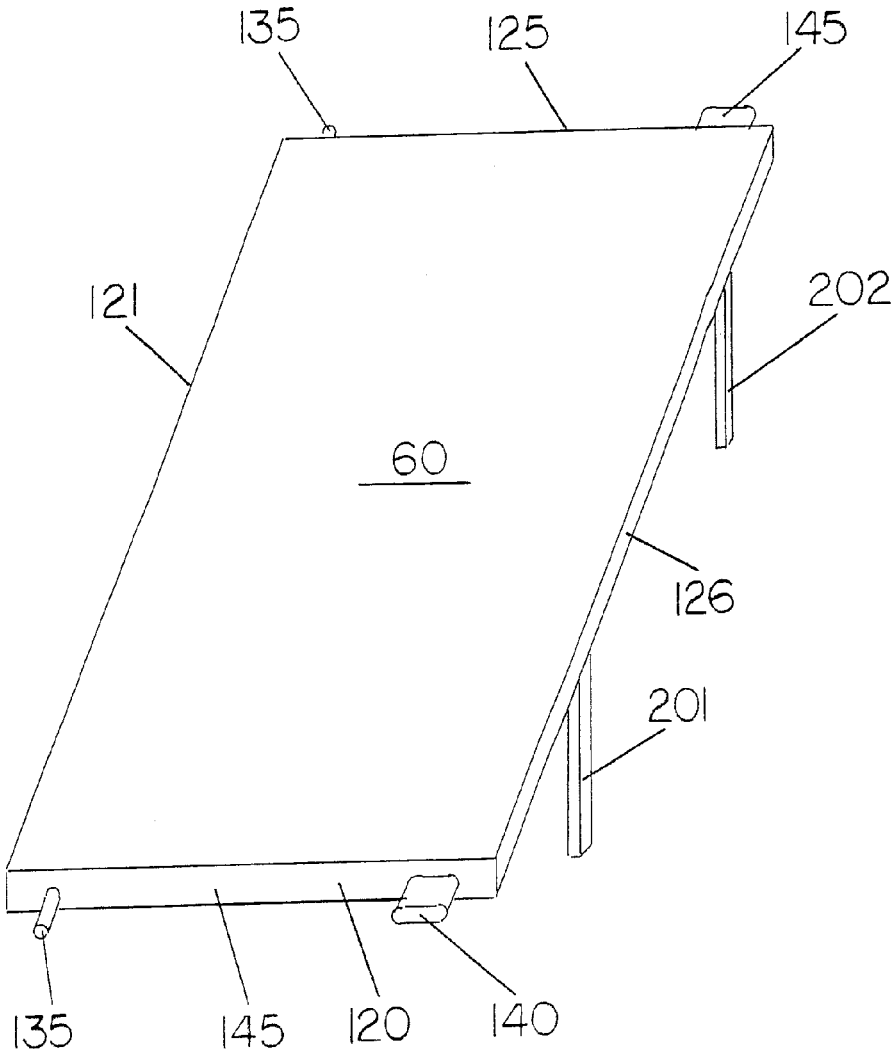
FIG. 9 is a front perspective illustration of the support panels 58.
Figure 9A:
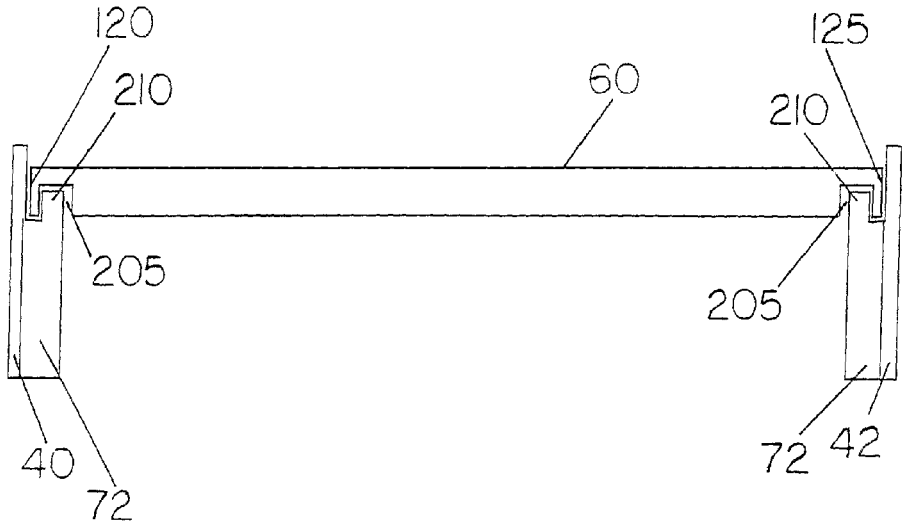
FIG. 9A a side elevational view of the support panel and the cabinet of the multi-functional, multi-configurable furniture system.
Figure 10:
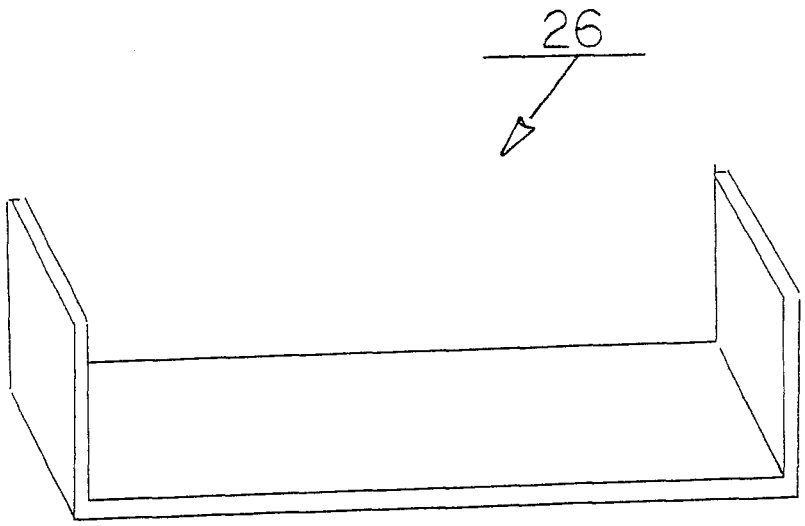
FIG. 10 is a front perspective illustration of the major shelving.
Figure 11:
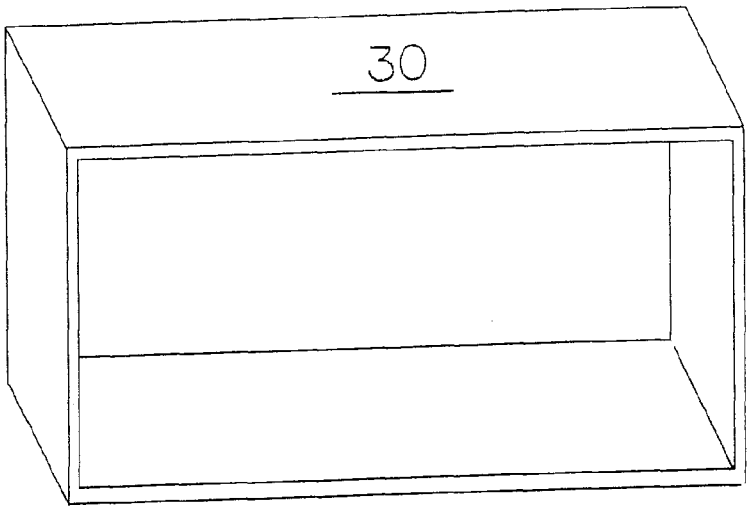
FIG. 11, FIG. 12, FIG. 13 and FIG. 14 are a front perspective illustration of the box shaped shelving assembly and of the box shaped shelving assembly having minor shelving and minor cabinets.
Figure 12:
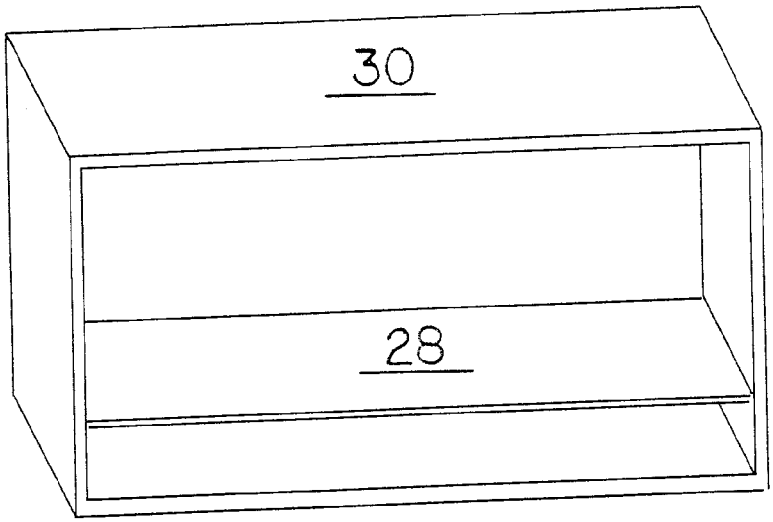
Figure 13:
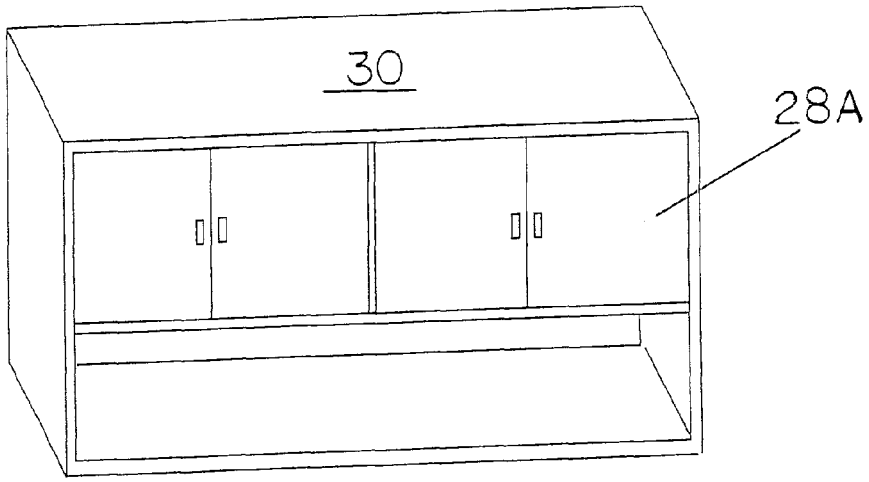
Figure 14:
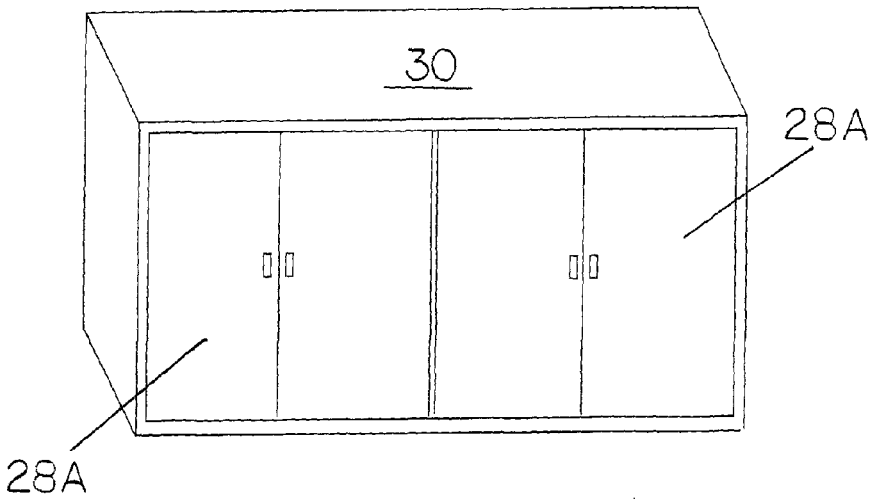
Figure 15:
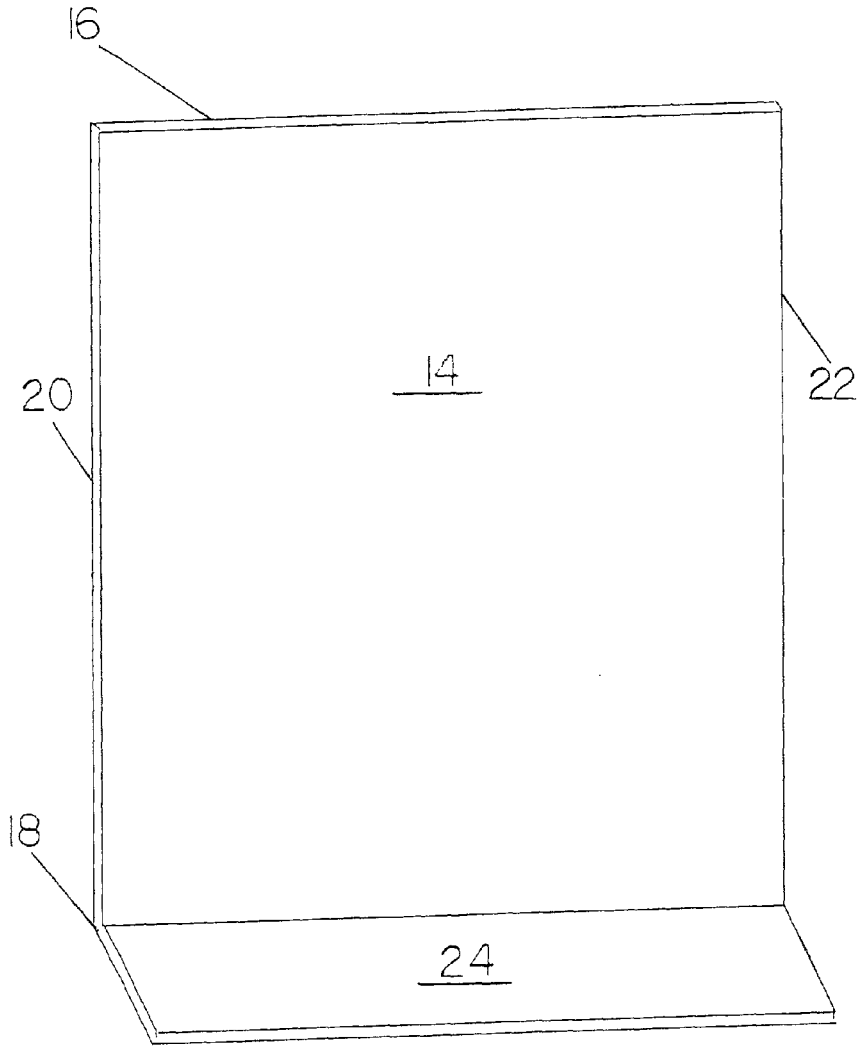
FIG. 15 is a front perspective illustration of the back plate and its major shelving and the box shaped shelving assembly and of the box shaped shelving assembly having minor shelving and minor cabinets shown in FIG. 10, FIG. 11, FIG. 12, FIG. 13 and FIG. 14 removed.
Figure 16:
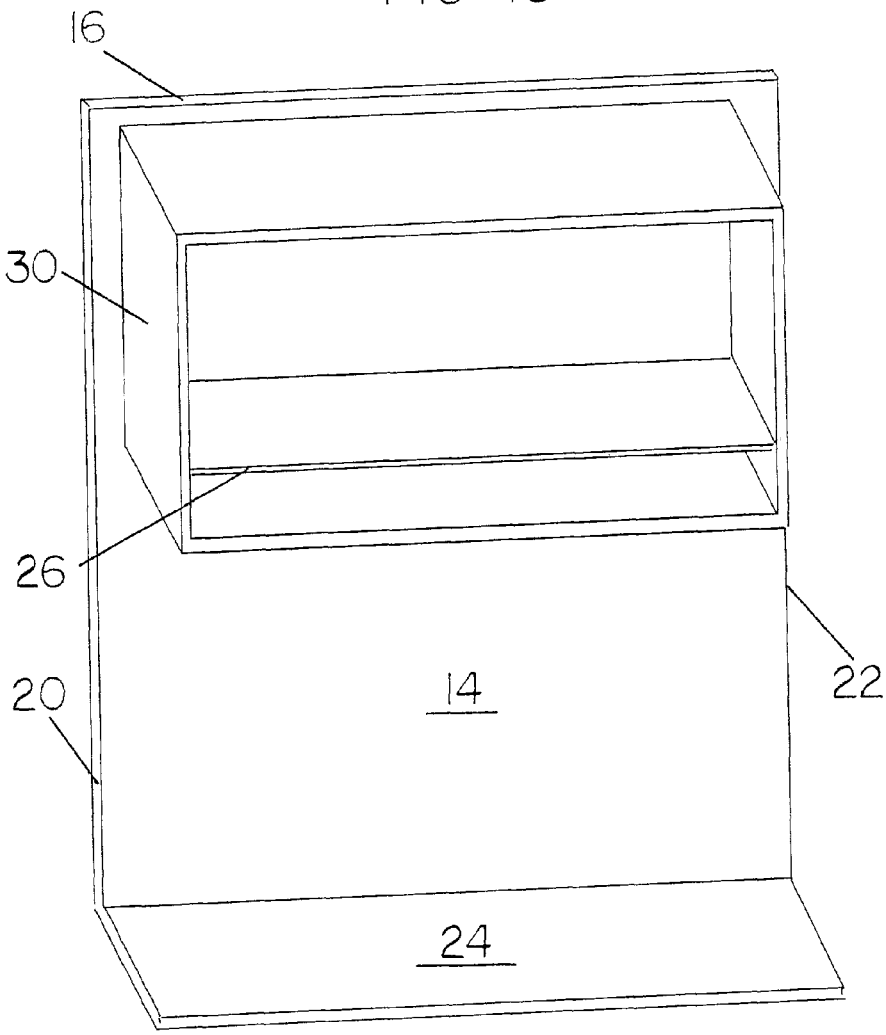
FIG. 16, FIG. 17 and FIG. 18 are a front perspective illustration of the back plate and its major shelving and the box shaped shelving assembly having minor shelving and minor cabinets shown in FIG. 10, FIG. 11, FIG. 12, FIG. 13 and FIG. 14.
Figure 17:
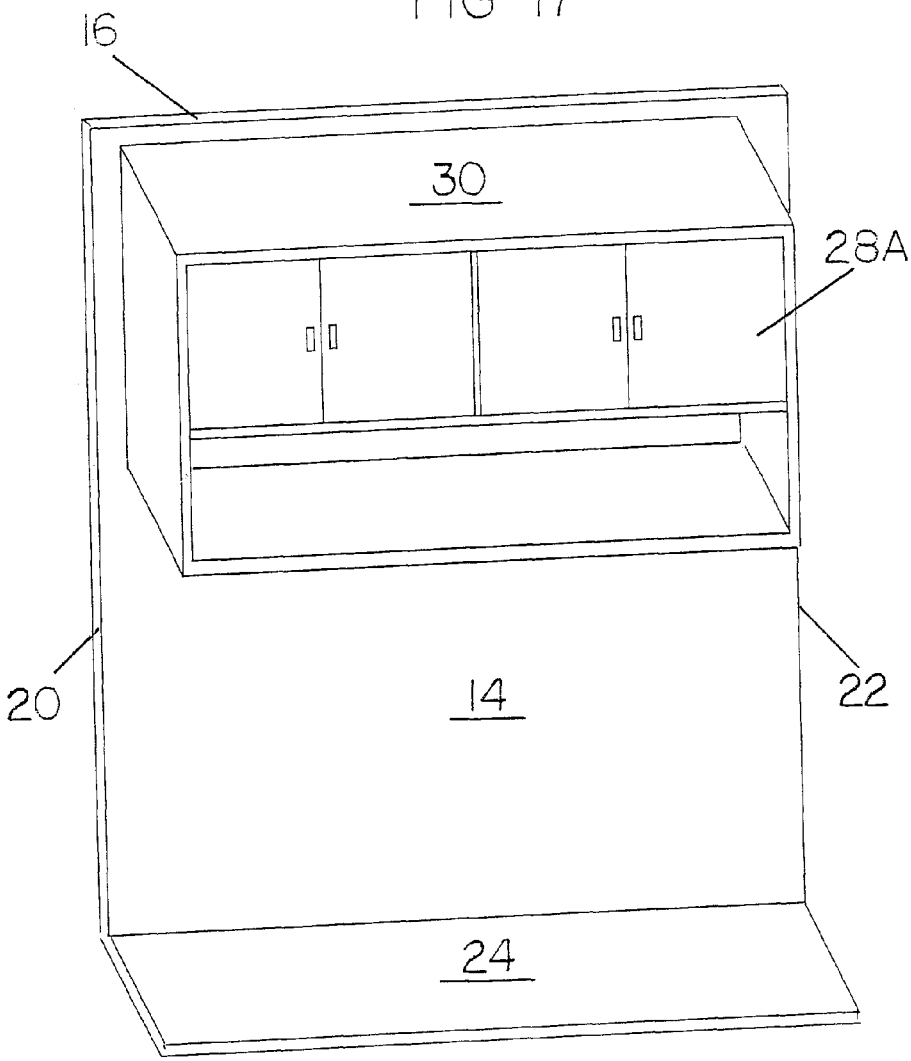
Figure 18:
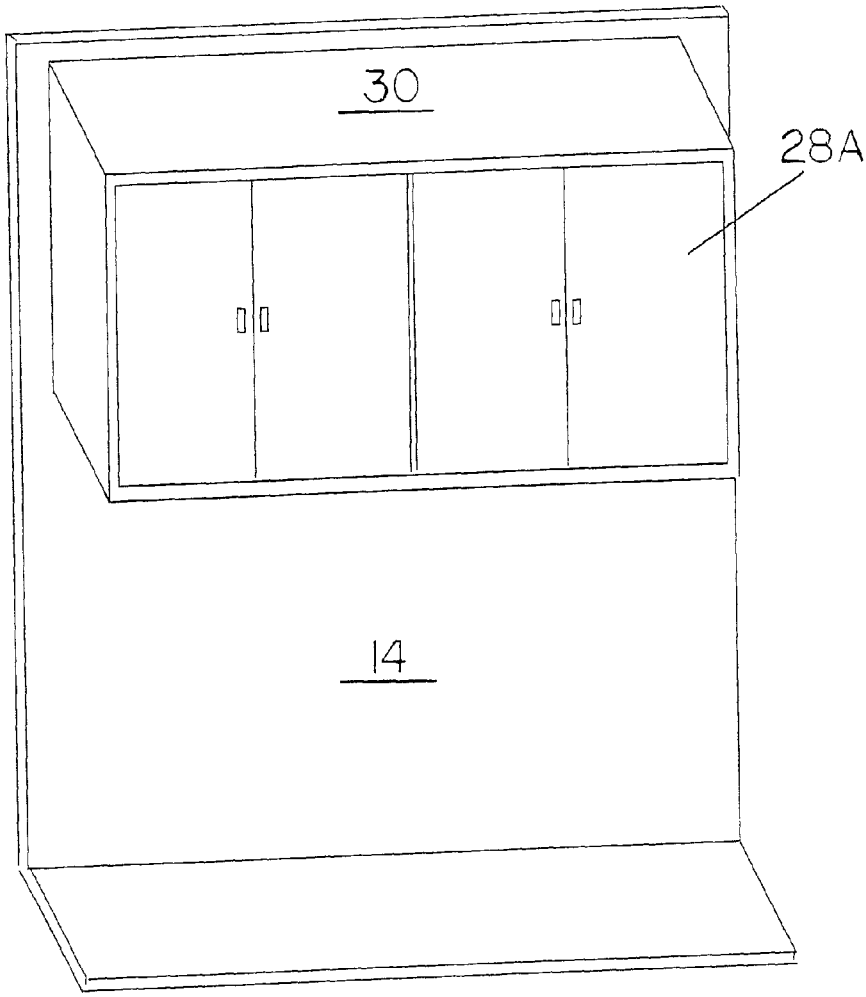

Next the lower panel 58 is provided with a door 74 as shown in FIG. 7. One or more of such doors is adapted to be formed in any one or more of the panels. This feature allows access by a user to the openings of the cabinet as well as to the housings when the cabinet is in the horizontal orientation and the openings are covered by the panels.

In the vertical orientation the cabinet is generally placed against other structure such as but not limited to walls of a building and the central opening is adapted to engage items such as but not limited to television and pictures, and these items are being secured to other objects such as but not limited to walls of a building.

Next provided are major shelving and box shaped shelving assemblies. The central opening is adapted to receive and engage the major shelving and the box shaped shelving assemblies and horizontal major shelf, and other items such as but not limited to television and pictures, and the storage shelving and cabinets. The minor shelves and minor storage cabinets of various sizes and combinations are provided for varying needs and requirements of the users of this system.

Horizontal major shelves 26 and a box-shaped shelving assembly 30 are provided for the central opening of the cabinet. Minor shelves 28 and minor cabinets 28A are also provided. The minor shelves and minor cabinets are being used interchangeably within the box-shaped shelving assemblies 30. Horizontal major shelves 26 are being used interchangeably in the center opening of the cabinet.

Next provided is a back plate 14. The major shelving and box shaped shelving assemblies are secured to the back plate 14 and thus avoiding the need for the major shelving and box shaped shelving assemblies to be secured other structures such as a wall. The back plate has a horizontal upper edge 16 and a parallel lower edge 18. The upper and lower edges are separated by a height of 6 feet. The back plate has a vertical left side edge 20 and a parallel right side edge 22. The left and right side edges are separated by a width of 7 feet. Cabinets of other sizes could be readily utilized. The back plate is vertically position able against and secured to a wall. A foot plate 24 is attached to the lower edge of the back plate. The foot plate has a width equal to the width of the back plate. The foot plate extends forwardly from the back plate for a depth equal to 25 percent of the height of the back plate. The horizontal major shelf 26 and the box-shaped shelving assemblies 30 are secured to the front of the back plate 14.

The back plate and foot plate are shown as a separate plates secured with respect to a wall and a floor. Such plates could, however, be part of the wall and the floor.

Next provided are accessory components, the accessory components enabling multi-configurable furniture system to adapt, merge or couple with other furniture or cabinets systems such as but not limited to kitchens cabinets. The accessory components of the multi-functional, multi-configurable furniture system also provides secondary storage space for storing or space for operationally coupling other furniture system such as but not limited to chairs and tables.

The accessory components have a left extension plate 300, right extension plate 305, the upper extension plate 310, and lower extension plate 315. The left extension plate 300, right extension plate 305, the upper extension plate 310, and lower extension plate 315 have back edges 320 and front edges 322. The cabinet is positioned against the front edges 322 of the extension plates. The back edges of the extension plates are vertically positionable against back plate 14 or secured to a wall. The extension plate is adapted to provide the secondary storage space 400 and this space being formed between the left extension plate 300, right extension plate 305, the upper extension plate 310, and lower extension plate 315.

This secondary/storage space provides the housing for accessory furniture and the mechanisms coupled to this furniture such as but not limited to foldable tables 405 and chairs 410.

An alternate embodiment is illustrated which has an optional air compressor 333 and tank 336 for storing compressed air. A valve 339 operatively coupled to the pipe supplying the compressed air to the tank, a second valve 338 coupled to the pipe that is coupled to the mattress and a third valve that is supplying the compressed air from the tank to the inflatable mattress are provided. The valve 339 allows the passage of the air only in one direction and the direction being from compressor 333 to the tank 336 The opening of the valve 338 allows the compressed air from the mattress to flow through the pipe 332 discharging the air thus deflating the mattress 337 and during when the mattress is inflated with the compressed air this valve 338 is closed. The valve 338 is open to inflate the mattress with the compressed air stored in the tank thus inflating the mattress quicker and the valve 338 is closed when the compressed air is being stored in the tank. A switching device having computer and programs is provided to control the opening and closing functions of the valves 336 and 338.

The furniture system of the present invention has a plurality of configurations such as, but not limited to a bed, sofa and shelf of which, in its storage phase, the components of the system are formed as a shelf configuration with open and closed front thus, not only requiring minimal space to store the components of the system, it is a functional shelf for storing and also displaying desired objects. The other unique capability of the present invention is that the objects stored or displayed on the shelves can remain on the shelves when the components of this furniture system are used in its other configuration such as a bed.

The next provided is a space in between the foot plate and the lower plate of the cabinet. This space forms the housing for items such as drive mechanisms operatively coupling the cabinet and the back plate for providing movement of the cabinet with respect to the back plate between a horizontal orientation and a vertical orientation.

In another embodiment of the invention, the mattress support panels include means to reinforce structural stability and prevent unwanted buckling and lateral displacement of the left and right plates of the cabinet. Also in this embodiment, the support panels have a linear recess channel adapted to receive the inner half section of the top edges.

The invention, in a final embodiment, includes a multi-functional, multi-configurable furniture system adapted to provide a plurality of configurations, functions and components. The system includes components of the furniture system, in a vertical orientation, having at least a cabinet and the cabinet further having an upper section with a central opening. Next provided are a plurality of support panels which are being stacked in a laterally oriented position. The cabinet is adapted to be placed against a structure such as but not limited to a wall. Also included are engaging items such as but not limited to a television and items such as but not limited to the major shelving and box shaped shelving assemblies. Further, the cabinet has a horizontal orientation with a top opening and alternate configuration to function such as but not limited to a bed or sofa. In this configuration the support panels is repositionable to span the horizontal top opening of the cabinet. The repositioning of such components is done by mechanisms such as but not limited to hinges, rails and or manually repositioning the components in part or as whole.

It is within the scope of this invention that this system in part or as whole be a part or component of an another systems such as but not limited to other cabinets such as kitchen cabinets, It is within the scope of this invention that another systems such as but not limited to other cabinets system in part or as whole be a part or component of this invention.

To keep the description to the sprit of this invention and not to deviate from the details of this invention certain descriptions of components such as shelves, related cabinets, and safety features and movement mechanisms are omitted in this description of this invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi-functional, multi-configurable furniture system for generally conversion to a cabinet during the day and for conversion to a bed during the night, the system comprising, in combination:

a back plate (14) having a horizontal upper edge (16) and a parallel lower edge (18) separated by a height of 6 feet, the back plate having a vertical left side edge (20) and a parallel right side edge (22) separated by a width of 7 feet, the back plate being vertically positionable against and secured to a wall, a foot plate (24) attached to the lower edge of the back plate, the foot plate having a width equal to the width of the back plate, the foot plate extending forwardly from the back plate for a depth equal to 25 percent of the height of the back plate, the back plate being formed with a vertical front section and front of the back plate (14), major shelves (26) and box-shaped shelving assemblies (30) received in the vertical front section and front of the back plate;

a cabinet (34), having a horizontal upper plate (36) and a parallel lower plate (38) separated by a height of 6 feet, the cabinet having a vertical left side plate (40) and a parallel right side plate (42) separated by a width of 7 feet, the cabinet having a intermediate plate (44), and the upper section above the intermediate plate (44) having a central opening (46) between the horizontal intermediate plate (44), the horizontal upper plate (36), the vertical left side plate (40) and the vertical right side plate (42) a left side opening between the left side plate and the left intermediate plate, a right side opening between the right side plate and the right intermediate plate, a left housing (48) with front doors, the left housing being in the left side opening and being secured to the lower plate and having a height of 1.5 feet, a right housing (50) with front doors, the right housing being in the right side opening and being secured to the lower plate and having a height of 1.5 feet, the cabinet being movable between a horizontal orientation and a vertical orientation, the horizontal orientation positioning the cabinet upon the floor laterally spaced from the foot plate with the upper and lower plates vertically disposed, the vertical orientation positioning the cabinet upon the foot plate and against the back plate and with the intermediate plates separating the major shelf from the minor shelves and with the upper and lower plates horizontally disposed;

an inflatable mattress (56) adapted to be deflated and inserted into one of the housings when the cabinet is in the vertical orientation, the inflatable mattress adapted to be inflated and placed upon the cabinet when in the horizontal orientation;

three similarly configured support panels including a lower panel (58), a middle panel (60), and an upper panel (62), the support panels being coupled to the cabinet, the lower panel (58) secured to the cabinet and having a rear opening and doors and having hinges (66) coupled to the middle panel (60) and the upper panel (62) for pivoting the middle panel (60) and the upper panel (62) from a laterally stacked vertically oriented position to a position spanning the rear opening when in the horizontal orientation; and a stacking assembly including four laterally extending projections (135) (140) extending from each of the two upper panels, the upper plate being formed with opposed parallel slots for slidably receiving the lateral projections whereby the support panels are slidable in a first direction for positioning in a stacked orientation when in the vertical orientation and slidable in a second direction for re-positioning and spanning the openings when in the horizontal orientation, whereby the panels will totally cover the openings and provide full support for the inflated mattress.

2. The system as set forth in claim 1 wherein the center mattress support panels are further provided with at least one center mattress support member (201), (202), the center mattress support members being rectilinear and extending in a downwardly direction and the dimension of height being of a length as great as the dimension from the top edges of the load bearing peripheral plates (72) and the bottom edges of the top (36), bottom (38), left (40) and right (42) plates, the center mattress support members being fixedly abutting at the bottom surface and in a close proximity to the front edges (126) of the middle support panel (60).

3. The system as set forth in claim 2 wherein the furniture and mattress are fabricated in various sizes, shapes and functions and have the means to be adapted to include such variations in size, materials, shape, form, function and manner of operation, assembly and use.

4. The system as set forth in claim 1 wherein the mattress support panels include means to reinforce structural stability and prevent unwanted buckling and lateral displacement of the left and right plates of the cabinet, and wherein the support panels have a linear recess channel adapted to receive the inner half section of the top edges.

* * * * *